United States Patent [19]

Fishburne

[11] 3,968,619

[45] July 13, 1976

[54] METHOD AND APPARATUS FOR PRODUCING ENCLOSED BALES OF COMPRESSIBLE MATERIAL

[76] Inventor: Francis B. Fishburne, P.O. Box 338, Arden, N.C. 28704

[22] Filed: Sept. 2, 1975

[21] Appl. No.: 609,673

[52] U.S. Cl. ..... 53/24; 53/124 D; 53/124 TS; 100/218; 141/12; 141/71

[51] Int. Cl.[2] ..... B65B 13/20; B65B 63/02

[58] Field of Search ..... 53/24, 124 D, 124 TS; 100/218; 141/12, 71

[56] References Cited

UNITED STATES PATENTS 2,869,296 1/1959 Overman ..... 53/124 D X 3,566,576 3/1971 Ayres et al..... 53/124 D X

*Primary Examiner*—Travis S. McGehee

*Attorney, Agent, or Firm*—Roylance, Abrams, Berdo & Kaul

[57] ABSTRACT

Enclosed bales of compressible material such as tobacco are produced by forming a compressed cake of the material in a compression zone, placing the compression zone in communication with a laterally extending sleeve, placing a container such as a bag or carton over the sleeve in such fashion that a closed end of the container extends across the end of the sleeve, forcing the compressed cake of material through the sleeve, and positively moving the container off the sleeve at essentially the same rate at which the cake emerges from the sleeve.

22 Claims, 19 Drawing Figures

METHOD AND APPARATUS FOR PRODUCING ENCLOSED BALES OF COMPRESSIBLE MATERIAL

BACKGROUND OF THE INVENTION

Certain loose compressible materials have historically been packed by pressing them directly into a container such as a hogshead or a case. In the tobacco industry, presses have been developed which are capable of filling a hogshead or case with a single stroke of a vertical press ram. While such practices have numerous advantages and have achieved wide acceptance, they have the disadvantage that the empty container must be placed in the proper position preparatory to the pressing operation and that the packed container must then be moved out of the way, an operation which is time consuming and requires relatively expensive apparatus. Such press-in-the-container methods are also limited by the specific nature of the container employed, so that relatively large strong and relatively expensive containers are required. Such drawbacks have led to use of equipment which can form a large compressed cake of the tobacco or other material, with bale boards being provided at the bottom and top of the cake, and strapping then being applied about the bale boards to maintain the cake under compression, as shown in Hart et al U.S. Pat. No. 3,824,758.

It has also long been known to form bales of material, typically peat moss, asbestos, and the like, by pressing the material into a compression chamber and then ejecting the compressed cake from that chamber and applying a bag or wrapping to the ejected cake. Apparatus of this type are shown, for example, in U.S. Pat. Nos. Dederick 583,462; Roberts et al 2,984,172; and Stangl 3,089,410. While the tobacco industry has attempted to follow such practices in recent years, particularly for the production of bales substantially smaller than the hogshead and like more common forms of compressed packages, this trend has met with only limited success because of the relatively low production rates and particularly, the fact that the bales tend to bulge, or to be excessively rounded, at the end which leads as the compressed cake is ejected. There has accordingly been a continuing need for improvement of such methods and apparatus.

OBJECTS OF THE INVENTION

A general object is to provide an improved method for producing enclosed bales of compressible material.

Another object is to devise a method and apparatus capable of high rate production of enclosed bales of compressed material with the bales being of uniform weight and size and having square ends.

A further object is to provide such a method and apparatus capable of producing enclosed bales of various types.

SUMMARY OF THE INVENTION

Generally stated, method embodiments of the invention comprise compressing the tobacco or other material into a compression zone in the form of a hexahedron slightly smaller than the bale desired, providing a sleeve which extends away from one end of the compression zone, disposing the container about the sleeve with one end of the container extending across the end of the sleeve, placing the compression zone in communication with the sleeve, forcing the compressed cake out of the compression zone and through the sleeve, and positively moving the container off the sleeve simultaneously with ejection of the cake, and at the same rate of travel as the cake. In advantageous apparatus embodiments of the invention, the compressed cake is forced out of the compression zone and through the sleeve by an ejection ram and the step of positively moving the container over and off the sleeve is carried out by a pusher operated in timed relation with the ejection ram.

In order that the manner in which the foregoing and other objects are achieved according to the invention can be understood in detail, particularly advantageous embodiments thereof will be described with reference to the accompanying drawings, which form part of the original disclosure hereof, and wherein.

DETAILED DESCRIPTION OF THE METHOD

Figure 1:
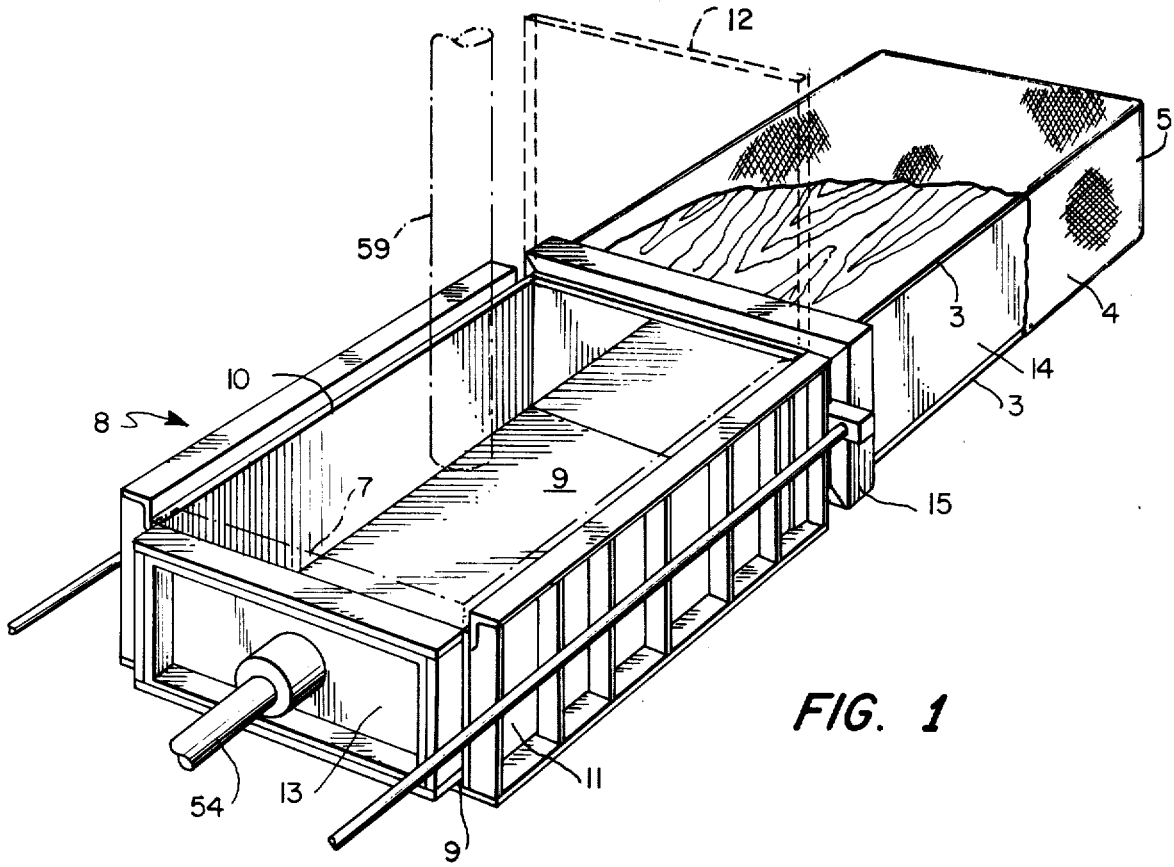
FIG. 1 is a perspective view of a portion of an apparatus for carrying out the method.
Figure 2:
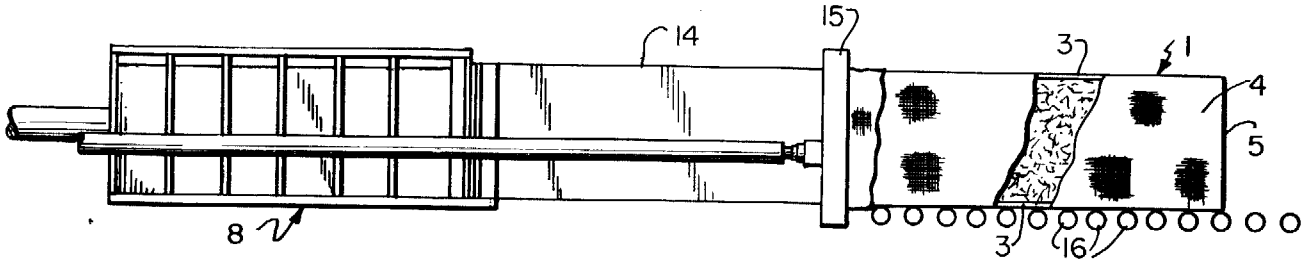
FIG. 2 is a side elevational view of the apparatus of FIG. 1 but with parts thereof in positions occupied at a subsequent stage of the method.
Figure 3:
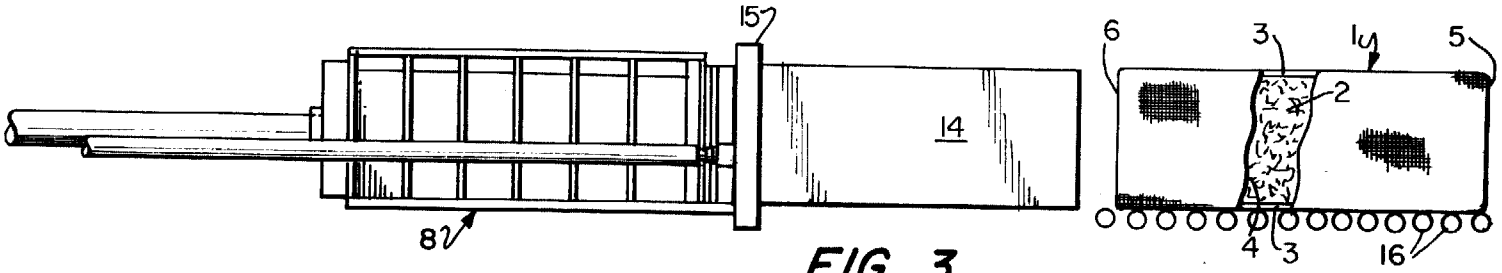
FIG. 3 is a view similar to FIG. 2 but with parts returned to their starting positions.

FIGS. 1–3 illustrate a typical method embodiment of the invention, employed to produce completed packages in the nature of a bale, indicated generally at 1, FIG. 3, comprising a compressed cake of material 2 which is in the form of a regular hexahedron, two flat bale boards 3 which are typically of plywood and each overlie a different one of the two major faces of the cake, and a bag 4 which is typically of burlap fabric and has an initially closed end 5 and an end 6 which is closed, as by sewing, to complete the package.

Compressed cake 2 is formed by supplying a preweighed quantity of the loose compressible material, such as tobacco, to an upright charger in the manner hereinafter described in detail with reference to the apparatus shown in FIGS. 11–18 and passing a press head 7 downwardly through the charger to compress the material into the compression chamber indicated generally at 8, FIG. 1. Chamber 8 is defined in part by a rigid flat bottom wall 9 and two upright side walls 10 and 11. Bottom wall 9 is in the form of an elongated rectangle, and walls 10 and 11 are in the form of mutually identical elongated rectangles of the same length as but smaller in width than the bottom wall. One end of chamber 8 is defined by a flat gate member 12, shown in broken lines in its raised position in FIG. 1 and later described in detail. The opposite end of the compression chamber is defined by the flat front face of an ejecting ram 13. Upon completion of the pressing stroke of press head 7, the flat rectangular lower face thereof defines the upper wall of the compression chamber. Thus defined, the dimensions of the compression chamber, and therefore of the compressed cake 2 when the cake is in the chamber, are slightly smaller than the dimensions intended for the cake in the finished bale 1.

A straight elongated sleeve 14 of rectangular transverse cross-section extends away from that end of chamber 8 which is defined by gate member 12 when the latter is in its lowered, active position. Sleeve 14 is slightly longer than the finished bale and of the same transverse cross-sectional shape and dimensions as chamber 8, the bottom, side and top walls of the sleeve constituting, in effect, continuations of the corresponding walls of the compression chamber. As later described, the compression chamber and sleeve are so constructed that the inner faces of the walls thereof are smooth and uninterrupted.

At an appropriate time during the pressing cycle, as while the charger is being filled, the combination of bale boards 3 and bag 4 is telescoped over sleeve 14, with one board overlying the top wall of the sleeve, the other board lying against the outer surface of the bottom wall of the sleeve, and the closed end 5 of the bag extending across the discharge end of the sleeve. Bag 4 fully encloses the sleeve and bale boards and is disposed about the sleeve in smooth, taut condition, with the surplus material which will form the end 6 folded back as seen in FIG. 2.

Ejecting ram 13 is arranged to be driven, as by a hydraulic power device, rectilinearly in directions lengthwise of the compression chamber 8 and sleeve 14. Extending about the entrance end of sleeve 14 is a rectangular pusher frame 15. Lying in a plane transverse to the axis of the sleeve, frame 15 has four straight sides each slidably engaging a different wall of the sleeve. With bale boards 3 and bag 4 disposed on sleeve 14 as shown in FIG. 1, like ends of the two bale boards engage the pusher frame, the opposite ends of the bale boards engaging the closed end 5 of the bag.

When the pressing operation is completed, gate member 12 is raised to its inactive position, placing the compression chamber in communication with the sleeve. Ejection ram 13 is is then driven toward the sleeve at a constant rate of travel, forcing the compressed cake 2 out of the compression chamber into the sleeve. As the compressed cake enters the sleeve, the air contained in the sleeve escapes relatively freely through the fabric making up end 5 of the bag, so that the bag and bale boards remain in place on the sleeve until the leading end of the cake reaches the discharge end of the sleeve and comes into contact with the closed end 5 of the bag. At that time, pusher frame 15 is driven toward the discharge end of the sleeve at the same rate of travel as the ejection ram, and advance of the ejection ram is continued. Movement of both the ejection ram and the pusher frame now continues until the ram and pusher frame have reached the discharge end of the sleeve. This simultaneous operation of the ejection ram and pusher frame forces the compressed cake of material through and out of the sleeve and positively moves the combination of the bale boards and bag over and away from the sleeve at the same rate of travel as the cake, so that the cake does not push against the closed end of the bag. When the compressed cake emerges from the sleeve, it is fully disposed within the container made up by the bale boards and bag, and all that remains is to position the material for end 6 and sew the same. The bale can be received by, e.g., a roller conveyor 16 for handling during sewing and for transport away from the pressing station.

It has been found that loose compressible materials such as leaf or strip tobacco, when pressed into a cake as described above, exhibit reexpansion when the compressed cake is released from confining pressure. While reexpansion occurs to a nominal extent in all directions, the amount of reexpansion is remarkably greater in the direction in which the cake was compressed, i.e., vertically in the method embodiment just described. Thus, as the cake emerges from the discharge end of sleeve 14, the cake expands significantly at right angles to bale boards 3, forcing the bale boards outwardly. The transverse dimensions of the compression chamber and sleeve are but slightly smaller than those of the container made up of the bale boards and bag when the bag is fully tensioned. Accordingly, reexpansion of the compressed cake, in forcing bale boards 3 apart, brings bag 4 into a fully tensioned, taut condition. Since only a small amount of reexpansion occurs lengthwise of the bale and transversely thereof in directions parallel to the bale boards, the ends and vertical sides of the bale remain essentially flat. Flatness of the end of the bale at end 5 of the bag is assured because, in emerging from sleeve 14, the cake does not push forcibly against bag end 5, pusher frame 15 causing the bag and bale boards to travel along with the cake.

As the bag is being sewn, pusher frame 15 and ejector ram 13 are returned to their original positions, and gate member 12 is lowered to ready the compression chamber 8 for the next pressing cycle.

Figure 4:
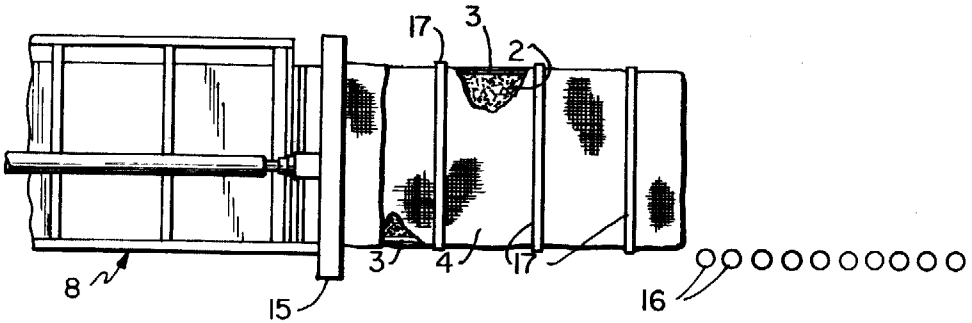
FIG. 4 is a side elevational view of the apparatus of FIG. 1, illustrating practice of the method to produce a strapped bale.

It is frequently desired that the bale 1 be provided with tie members, typically by use of conventional steel strapping. As seen in FIG. 4, such tie members 17 can be applied while the bag and bale boards are on sleeve 14, the steel strapping or the like being secured under only slight tension, and full tension thereof resulting when the compressed cake, having been ejected from the sleeve, reexpands as earlier described.

Figure 5:
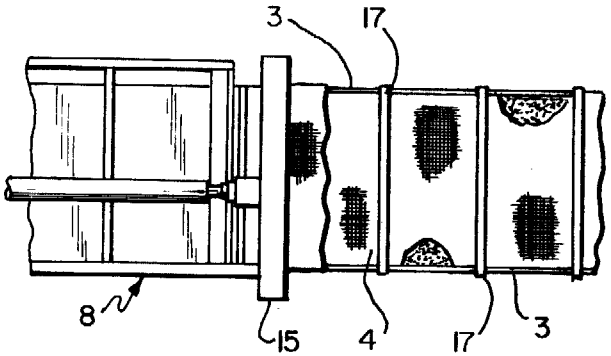
FIG. 5 is a view similar to FIG. 4 but showing a different form of strapped bale.

The procedure just described can be modified by placing bale boards 3 on the outside of bag 4, as seen in FIG. 5, presence of tie members 17 serving to securely retain the boards and to cause the bale boards and bag to move as a unit under the influence of pusher frame 15.

Figure 6:
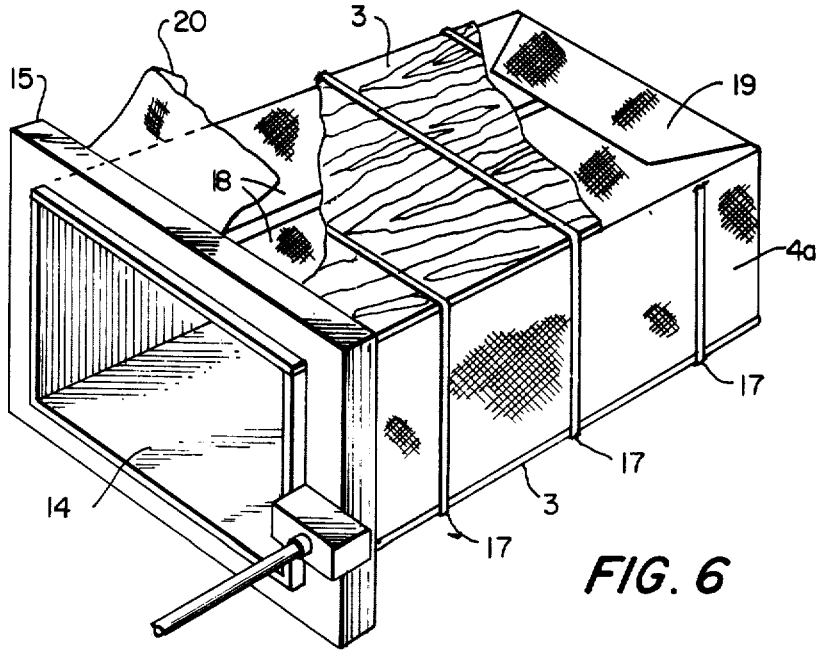
FIG. 6 is a perspective view illustrating the manner in which the method can be carried out to form yet another type of bale.

While the use of a fabricated bag as part of the container is advantageous, other equivalent container configurations can be employed. Thus, as shown in FIG. 6, a single rectangular piece 4*a* of paper, fabric, polymeric film or like flexible sheet material can be substituted for the bag. The sheet material is run along the outer surfaces of the vertical sidewalls of sleeve 14 and over the open discharge end of the sleeve. Edge portion 18 of the sheet are folded over to extend across the top and bottom, respectively, of the sleeve, and end folds 19 are formed and laid over to extend over the top and bottom of the sleeve. Bale boards 3 are then put in place over the sheet material, one over the top of the sleeve, the other over the bottom, and steel strapping applied at 17 with less than full tension. Adjacent pusher frame 15, enough excess length of the sheet material is provided to allow the free ends, such as that indicated at 20, to be folded over the trailing end of the compressed cake when the cake has been ejected from the sleeve. Such free ends can be secured by adhesive tape to complete the bale.

Figure 7:
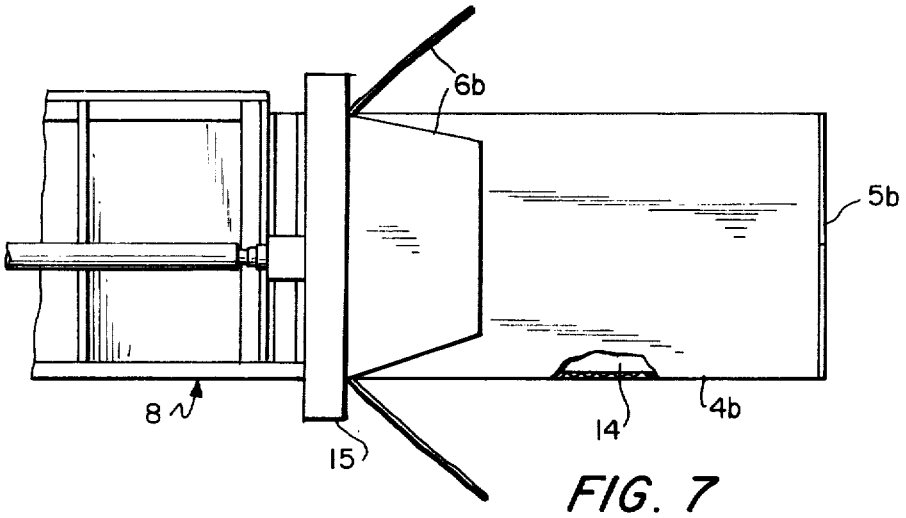
FIG. 7 is a side elevational view illustrating practice of the method to produce bales enclosed in a carton.

The method can also be carried out with cartons formed of box board, the carton being so dimensioned that it can be telescoped over the sleeve, as seen in FIG. 7, with a tight but slidable fit. The carbon 4*b* can be of conventional folded construction, with one end 5*b* being initially closed so as to extend across the discharge end of sleeve 14. End flaps 6*b*, at the other end of the carton, are bent back as shown so that the open end of the carton is in flush engagement with the face of pusher frame 15. When the compressed cake of material has been ejected from the sleeve, with the carton moving off the sleeve concurrently under the action of the pusher frame, flaps 6*b* can then be folded over and adhesively secured to complete the bale.

Figure 8:
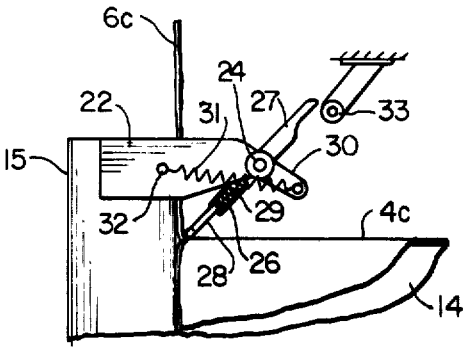
FIGS. 8 and 8A are side elevational views illustrating how the method can be carried out with containers which do not allow trapped air to escape freely.
Figure 9:
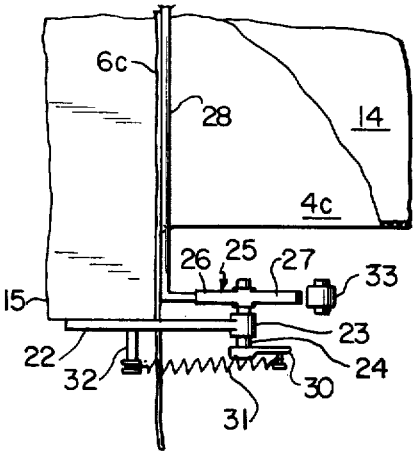
FIG. 9 is a top plan elevational view of the apparatus shown in FIG. 8.

Cartons of the general type referred to with respect to FIG. 7 can be used in conjunction with a liner of paper, polyethylene film, or the like. When used without such liners, the cartons usually present enough openings, as in the folded and adhesively secured end structure 5*b*, FIG. 7, to allow air to escape from the sleeve, as the compressed cake is forced through the sleeve while the carton remains stationary, so there is no tendancy for the air to push the carton off the sleeve in advance of the compressed cake. When the carton is employed with a liner, however, and when the carton itself is especially air-tight, it is necessary to compensate for the air trapped in sleeve 14 between the advancing compressed cake and the end wall of the carton extending across the sleeve. As shown in FIG. 8–9, relative movement between the carton and the sleeve is prevented, prior to operation of the pusher frame, by releasably securing the open end of the carton to the pusher frame, thus preventing the trapped air from forcing the carton off the sleeve.

One side of the pusher frame 15, typically the side which extends across the top of sleeve 14, is equipped at each end with a mounting bracket 22 projecting toward the discharge end of sleeve 14. Each bracket 22 carries at its free end a bearing 23, the two bearings being mutually aligned transversely of the sleeve to define an axis parallel to the adjacent wall of the sleeve. As best seen in FIG. 9, each bearing 23 rotatably supports a stub shaft 24 and each stub shaft carries a member 25 which includes a tubular arm 26 and a second arm 27, the two arms extending radially from the hub of member 25. A generally U-shaped carton-holding member 28 has its ends slidably engaged in the respective tubular arms 26, a compression spring 29 being provided in each arm 26 to bias member 28 radially away from the axis defined by bearings 23. A lever arm 30 is secured to each stub shaft 24 on the outboard side of the bracket. A tension spring 31 has one of its ends connected to the outer end of arm 30 and the other of its ends connected to a pin 32 secured to bracket 22. The relative positions of bearings 24, arms 26 and 27, arms 30 and pins 32 are such that springs 31 provide an over-center bias for each member 25. Thus, whenever lever arm 30 projects slightly downwardly, spring 31 urges member 25 to swing downwardly and toward pusher frame 15, so that the base of the U of member 28 swings into a position lightly clamping the corresponding end flap 6*c* of carton 4*c* against the face of pusher 15 which is directed toward the discharge end of sleeve 14. On the other hand, whenever arm 30 slants upwardly and away from the pusher frame, spring 31 swings member 25 away from the pusher frame.

Figure 8A:
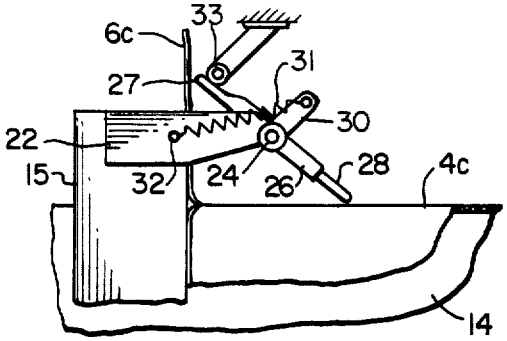

When carton 4*c* has been telescoped over sleeve 4*c*, members 25 can be manipulated manually to bring members 28 to the carton-holding position shown in FIGS. 8 and 9 and engagement of member 28 in the fold between flap 6*c* and the body of the carton is effective to secure the carton on sleeve 14 against the action of air trapped between the advancing compressed cake and the closed end of the carton. At a point spaced a small distance from the free end of arm 27 toward the discharge end of the sleeve, there is provided a stationary actuating roller 33, the roller being positioned in the path which the free end portion of arm 27 follows as the pusher frame 15 is advanced. When the compressed cake of material reaches the discharge end of the sleeve, advance of the pusher frame at the same rate as the cake commences, arm 27 engages roller 33, and arm 27 is swung to the position seen in FIG. 8A, releasing the carton from the pusher frame.

Figure 10:
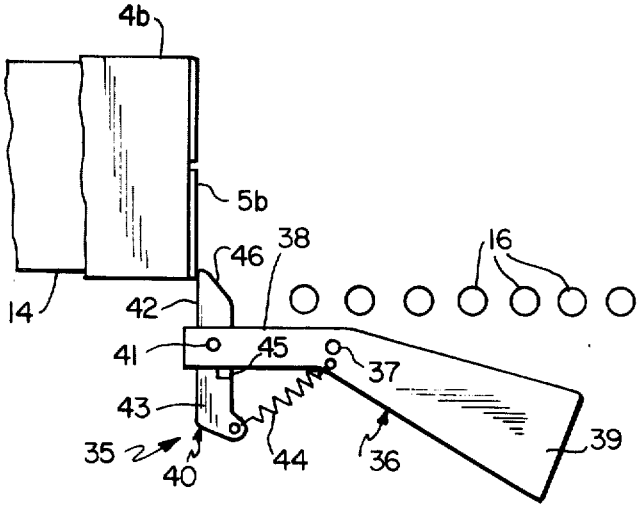
FIG. 10 is a fragmentary side elevational view illustrating another manner of carrying out the method when the container does not allow free escape of trapped air.

Alternatively, as seen in FIG. 10, this step of the method can be carried out by interposing a stop in the path of travel of the carton, the stop being arranged to yield under the force of the emerging cake of compressed material but not under the smaller force applied to the carton by the trapped air. Here, the stop device is indicated generally at 35 and comprises two arms 36 each located at a different side of roller conveyor 16 and mounted to pivot about the common axis 37 which extends transversely of and below the conveyor. Each arm 36 includes a smaller end portion 38, which projects from axis 37 toward the location of the discharge end of sleeve 14, and a larger, counterweighted end portion 39 extending in the opposite direction. Two stop arms 40 are provided, each mounted on the end portion 38 of a different one of the two arms 36. Stop arms 40 are mounted to pivot about a common axis 41 which is parallel to axis 37. Each stop arm 40 includes a first portion 42, which projects generally upwardly from the corresponding arm 36, and a second portion 43 which depends from the corresponding arm 36. Arms 40 are biased to a normal upright position by tension springs 44, each spring 44 being connected at one end to the tip of portion 43 of the corresponding arm 40 and at the other end to a point on the associated arm 36 adjacent axis 37. Springs 44 thus bias the arms 40 to rotate counter-clockwise, as viewed in FIG. 10, and a stop 45 is provided on each stop arm to engage the lower edge of arm portion 38 when the stop arm has been swung by spring 44 to a position which is substantially vertical when arms 36 are in the normal positions determined by counterweighted end portions 39.

The edges of stop arms 42 presented toward the discharge end of sleeve 14 are vertical when the stop arms are in the upright position determined by stops 45. The opposite edges of stop arms 42 include straight portions 46 which slant downwardly and away from sleeve 14. When it is desired to telescope a carton 4*b* over the sleeve 14, the carton is merely advanced on roller conveyor 16, open end first, and the leading edge of the wall of the carton which rests on the roller conveyor engages slanted edge portions 46, camming both assemblies 35 counter-clockwise (as viewed in FIG. 10) until the stop arms 40 are moved out of the way. When the carton has been telescoped fully onto sleeve 14, end wall 5*b* of the carton has passed beyond stop arms 40 and the stop devices 35 rotate counter-clockwise (as viewed) under the influence of counterweighted arm portions 39, until the upper end portions 42 of the stop arms are disposed generally against carton end wall 5*b*.

When ejector 13, FIG. 1, is operated to push the compressed cake of material through sleeve 14, the tendancy for carton 4*b* to be forced off of sleeve 14 by the trapped air in advance of the compressed cake is effective only to cause carton end wall 5*b* to come into engagement with stop arm portions 42. Until the entrapped air has been dissipated, the force applied to the stop arms by the carton is inadequate to overcome the biasing action of springs 44, and the carton is prevented from moving off of sleeve 14. However, as the compressed cake begins to emerge from the discharge end of sleeve 14, the force applied to the stop arms increases greatly, overcoming the biasing action of springs 44 and forcing stop arms 40 to swing clockwise, as viewed in FIG. 10, to retracted positions such as that the carton can ride over the stop arms and onto roller conveyor 16.

It will be noted that, in all of the method embodiments described with reference to FIGS. 1–10, the container is maintained on the sleeve until the compressed cake reaches the discharge end of the sleeve, and the container is then advanced positively at the same rate of travel as the compressed cake.

DETAILED DESCRIPTION OF APPARATUS EMBODIMENT OF FIGS. 11–18

FIGS. 11–18 show one particularly advantageous apparatus for carrying out the method as just described. The apparatus comprises a horizontal base frame 50 and vertical frame 51. The base frame rigidly supports the compression chamber 8 as well as the horizontally disposed hydraulic motor 52 comprising cylinder 53 and piston rod 54 on which the ejecting ram 13 is mounted. Frame 51 supports a vertical tubular charger 55 having a rectangular transverse cross-section corresponding to the plan shape of the compression chamber. The lower end of the charger is attached directly to the open top of the compression chamber. A conventional distributor 56, advantageously constructed according to my U.S. Pat. No. 3,595,282, issued July 27, 1971, is mounted at the top of charger 55. Also supported by vertical frame 51 is a vertical hydraulic motor 57 comprising a power cylinder 58 and piston rod 59. Press head or ram 7 is secured to the lower end of rod 59, ram 7 being of such plan shape and dimensions as to be capable of passing completely through charger 55 and distributor 46, one complete downstroke of the motor 57 causing ram 7 to completely traverse the charger, compressing the tobacco or other compressible material therein into the compression chamber 8. At the end of the downstroke, ram 7 comes to rest in the position shown in FIG. 1, the ram now constituting the top wall of the compression chamber. The loose compressible material to be compressed is supplied from a weighing device (not shown) by conveyor 60 under suitable control such that each cycle of operation fills the charger with a predetermined quantity of loose compressible material which, when compressed into chamber 8 by a single stroke of the press ram, will provide a compressed cake of material of predetermined weight.

Figure 12:
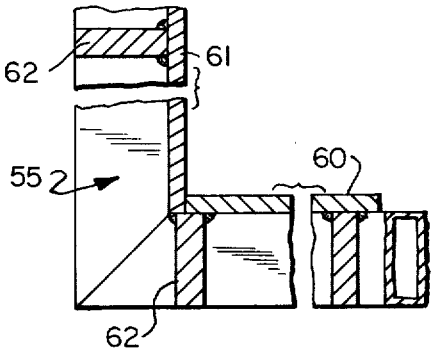
FIG. 12 is a fragmentary transverse sectional view taken on line 12—12, FIG. 11.

As will be clear from FIG. 12, charger 55 is constructed of flat metal plates 60 and 61 and is reinforced over most of its length by vertical bars 62 which are welded to the outer surfaces of the plates. The transverse cross-section of the charger is in the form of an elongated rectangle matching the plan configuration of the compression chamber 8. The longer sides of the rectangular cross-section of the charger are defined by plates 60, and the bottom end portions thereof are provided with transverse angle members 63, FIG. 13, the outwardly projecting web 64 of each member 63 being clamped, as by bolts 65, to the corresponding web 66 of an angle member 67 which extends along the upper edge of the corresponding side wall 10, 11 of compression chamber 8.

Figure 13:
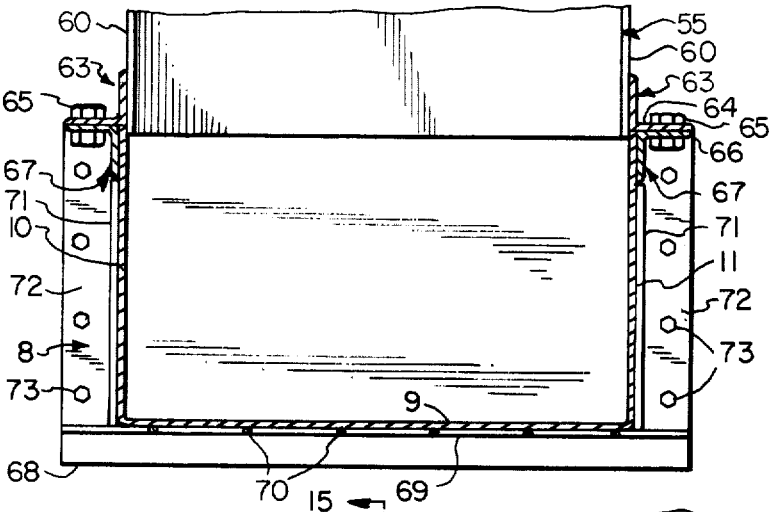
FIG. 13 is a vertical sectional view illustrating the manner in which the charger and compression chamber are joined together in the apparatus of FIG. 11.

Walls 9–11 of the compression chamber are formed of a steel plate, and bottom wall 9 is reinforced by angle members 68, the horizontal webs 69 of members 68 being notched to accommodate welds 70, FIG. 13. The ends of walls 10 and 11 adjacent sleeve 14 are reinforced by vertically extending angle members 71, FIGS. 13 and 14, and the outwardly projecting webs 72 of members 71 are secured by bolts 73 to like webs 74, FIG. 14, of angle members 75 carried by the side walls of sleeve 14, the sleeve thus being rigidly clamped to the compression chamber. As seen in FIG. 1, the side and bottom walls of the sleeve 14 constitute, in effect, uninterrupted continuations of the corresponding walls of the compression chamber. However, the top wall of the sleeve stops short of the compression chamber, so that, when press ram 7 is in its fully lowered position, so as to form the top wall of the compression chamber, there is a gap between the press ram 7 and the adjacent edge of the top wall of the sleeve, adequate to accommodate gate 12.

Figure 14:
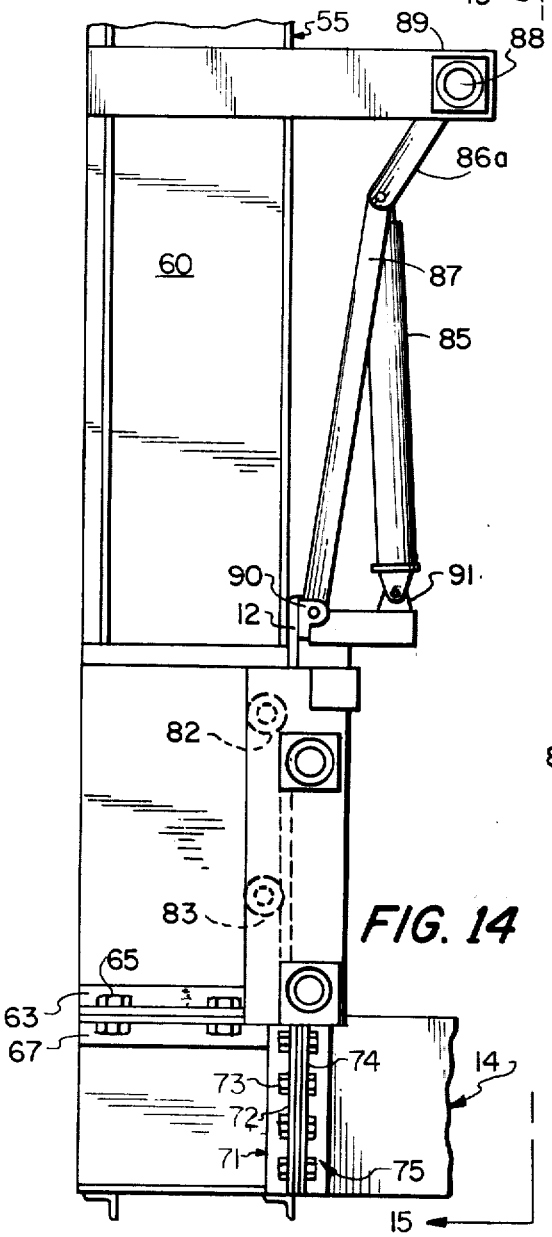
FIG. 14 is an enlarged fragmentary side elevational view of a portion of the apparatus of FIG. 11.
Figure 15:
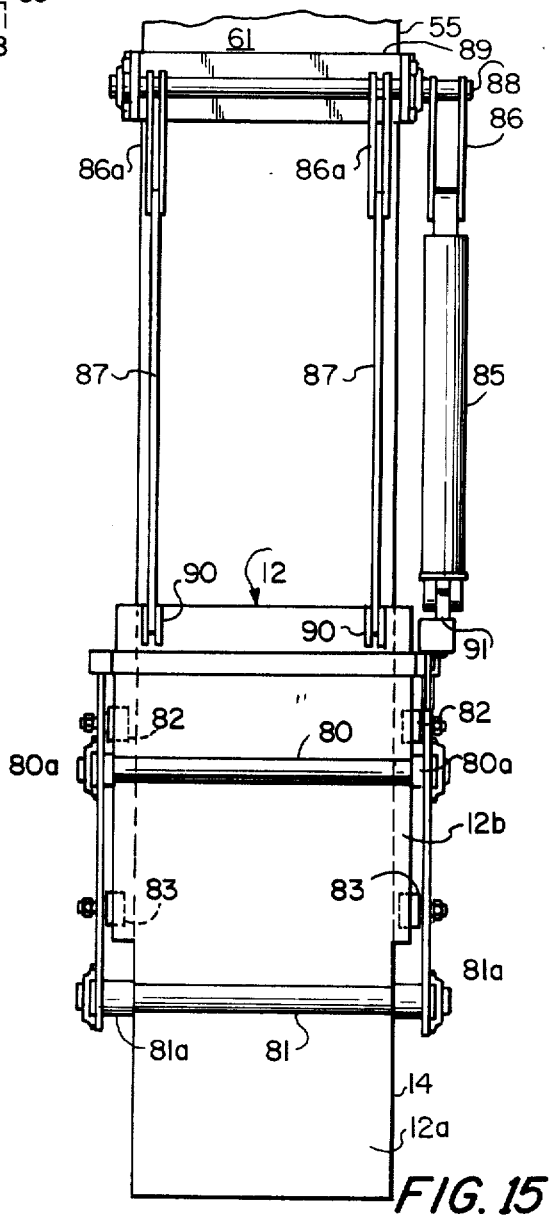
FIG. 15 is a side elevational view taken generally as indicated by line 15—15, FIG. 14.

Gate 12 is in the form of a heavy flat metal plate mounted for vertical movement between its raised position, in which the gate is completely removed from between the compression chamber and the sleeve, and its lowered position, seen in FIGS. 14 and 15, in which the gate acts as a rigid end wall of the compression chamber. As seen in FIG. 15, the lower portion 12*a* of gate 12 is of a shape and dimensions to completely close the mouth of sleeve 14, while the upper portion 12*b* is slightly wider. The gate is constrained for vertical movement by the combination of elongated rollers 80 and 81, which engage the face of the gate which is directed away from the compression chamber, and two pairs of short rollers 82 and 83, which engage the opposite face of the gate. All of rollers 80-83 are mounted for free rotation on two support plates 84 each mounted at a different side of the charger in a location immediately above the mouth of sleeve 14. Roller 80 has enlarged end portions 80*a*, FIG. 15, spaced axially by a distance only slightly larger than the width of the wider portion 12*b* of the gate, so that that portion of the gate is snugly accommodated between the end portions 80*a*. Roller 81 has enlarged end portions 81*a* spaced apart to accommodate the narrower portion 12*a* of the gate, the location of roller 81 being below gate portion 12*b* for all positions of the gate. A fluid pressure operated rectilinear motor 85 is provided to operate the gate through cranks 86 and 86*a* and levers 87, cranks 86 and 86*a* having their upper ends secured to a shaft 88 rotatable in bearings mounted on a girdle 89 forming parts of charger 55. The free end of crank 86 is pivoted to the free end of the piston rod of motor 85. The free ends of cranks 86*a* are pivoted to the upper ends of levers 87, the lower ends of levers 87 being connected to the upper portion 12*b* of the gate by clevis brackets 90. The lower end of the cylinder of motor 85 is pivotally mounted on the charger structure by a clevis bracket 91.

Operation of motor 85 to extend its piston rod rotates cranks 86, 86*a* clockwise, as viewed in FIG. 14, so that gate 12 is raised adequately to remove portion 12*a* completely from the mouth of sleeve 14, placing the compression chamber 8 in communication with the sleeve. Operation of the motor in the opposite sense rotates cranks 86, 86*a* counter-clockwise, as viewed in FIG. 14, driving the gate downwardly until portion 12*a* completely closes the mouth of sleeve 14 and forms the corresponding end wall of compression chamber 8. Rollers 80-83 constrain gate 12 rigidly against movement directions parallel to the longitudinal axis of sleeve 14.

Figure 11:
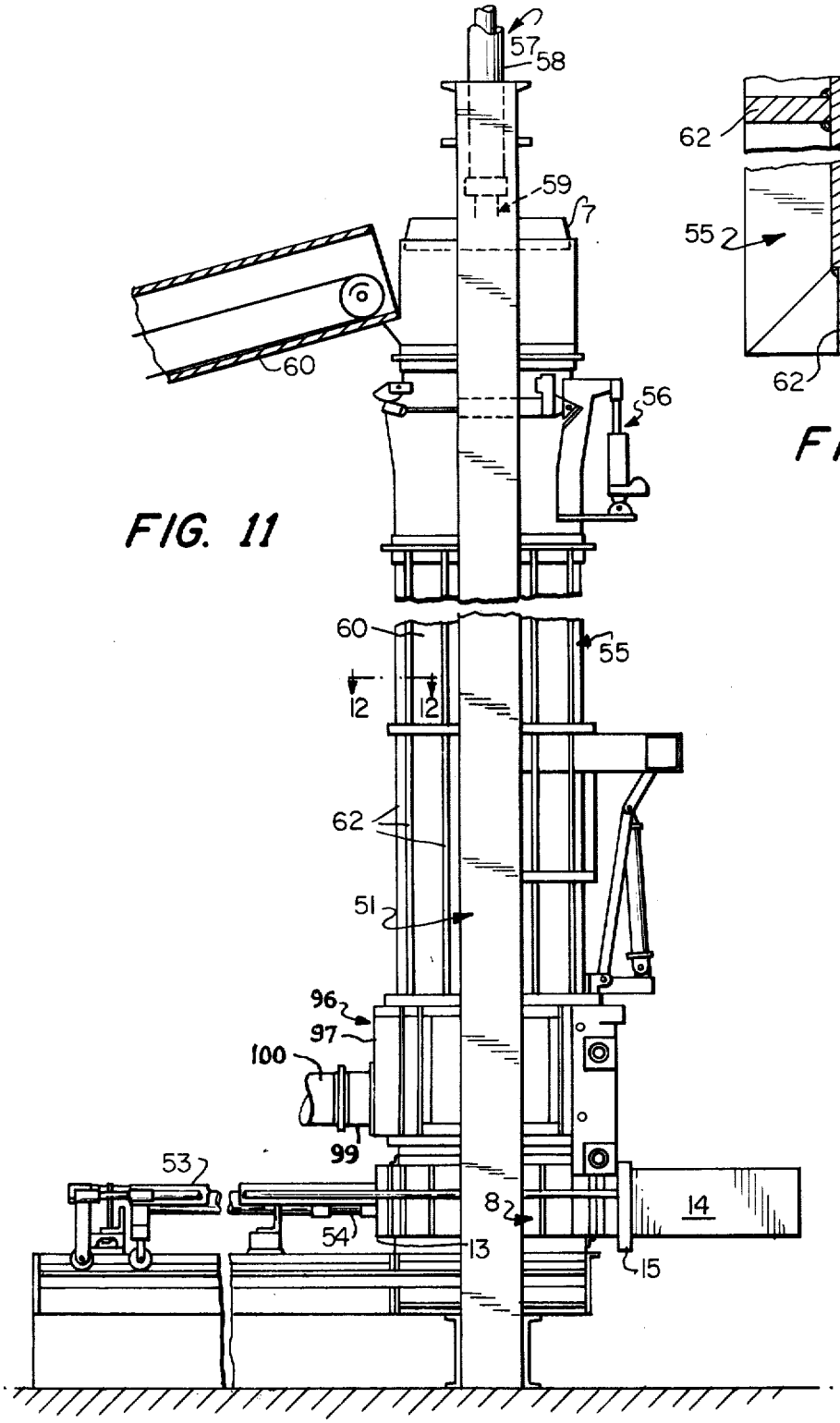
FIG. 11 is a side elevational view of an apparatus according to a particularly advantageous embodiment of the invention.
Figure 16:
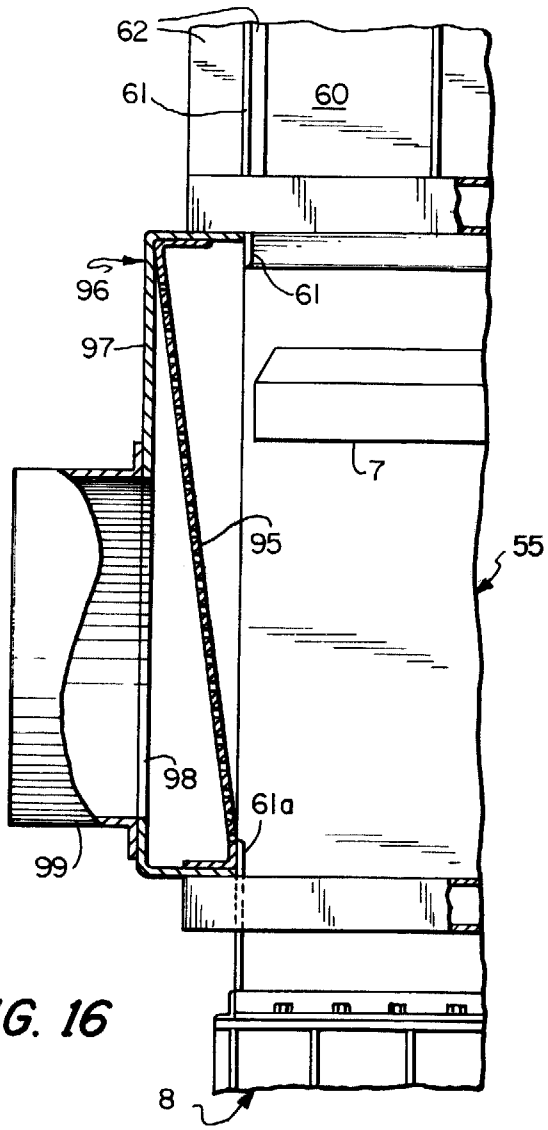
FIG. 16 is a fragmentary view, partly in vertical cross-section and partly in side elevation, showing means for exhausting air from the charger of the apparatus of FIG. 11 during the compression stroke.

When ejecting ram 13 and gate 12 are in their respective end-wall-forming positions, compression chamber 8 is practically air-tight save for its connection to charger 55. Press ram 7 fits in charger 55 with a snug, sliding fit, so that air present in the charger must be evacuated during the down stroke of the press. To allow relatively free flow air from the charger, the wall 61 thereof which is nearer ejector motor 52 extends only to a point spaced above the top of compression chamber 8 and, as shown in FIG. 16, that wall is there replaced by a flat perforated wall 95 which slants upwardly and outwardly, the lower edge of wall 95 joining side wall portion 61*a* and the upper edge of wall 95 being spaced a significant distance outwardly from the charger wall. Perforated wall 95 is mounted within and secured to a rectangular shroud 96 having a vertical outer wall 97 provided with an opening 98. A flanged tubular connector 99 is secured to wall 97 in registry with opening 98. As seen in FIG. 11, an exhaust conduit 100 is attached to connector 99 and runs to an exhaust fan (not shown). Save for wall 95, the side walls of charger 55 are imperforate. Wall 95 adequately relieves the charger for air exhaust during the compression stroke, and also serves as a screen to prevent passage of particulate material into the exhaust system. Provision of wall 95 in the manner shown has the advantage that the perforated inner face of the wall is not exposed to the action of ram 7 and there is accordingly little or no tendancy for the press ram and the perforated wall to coact in a manner such as to tear the tobacco or other compressible material during the down stroke of the ram. Further, loose fragments screened out of the air by wall 95 tends to gravitate into the compression chamber as ram 7 is raised following ejection of the compressed cake.

Motor 52 is a conventional double acting motor, the hydraulic flow lines having been omitted from the drawings for simplification and clarity. Cylinder 53 extends horizontally along the top of base frame 50 and is rigidly secured thereto, as by U-bolt 101 and cradles 102. The free end of piston rod 54 is rigidly secured to ejector ram 13, as by socket 103 and nut 104, FIG. 17.

Figure 17:
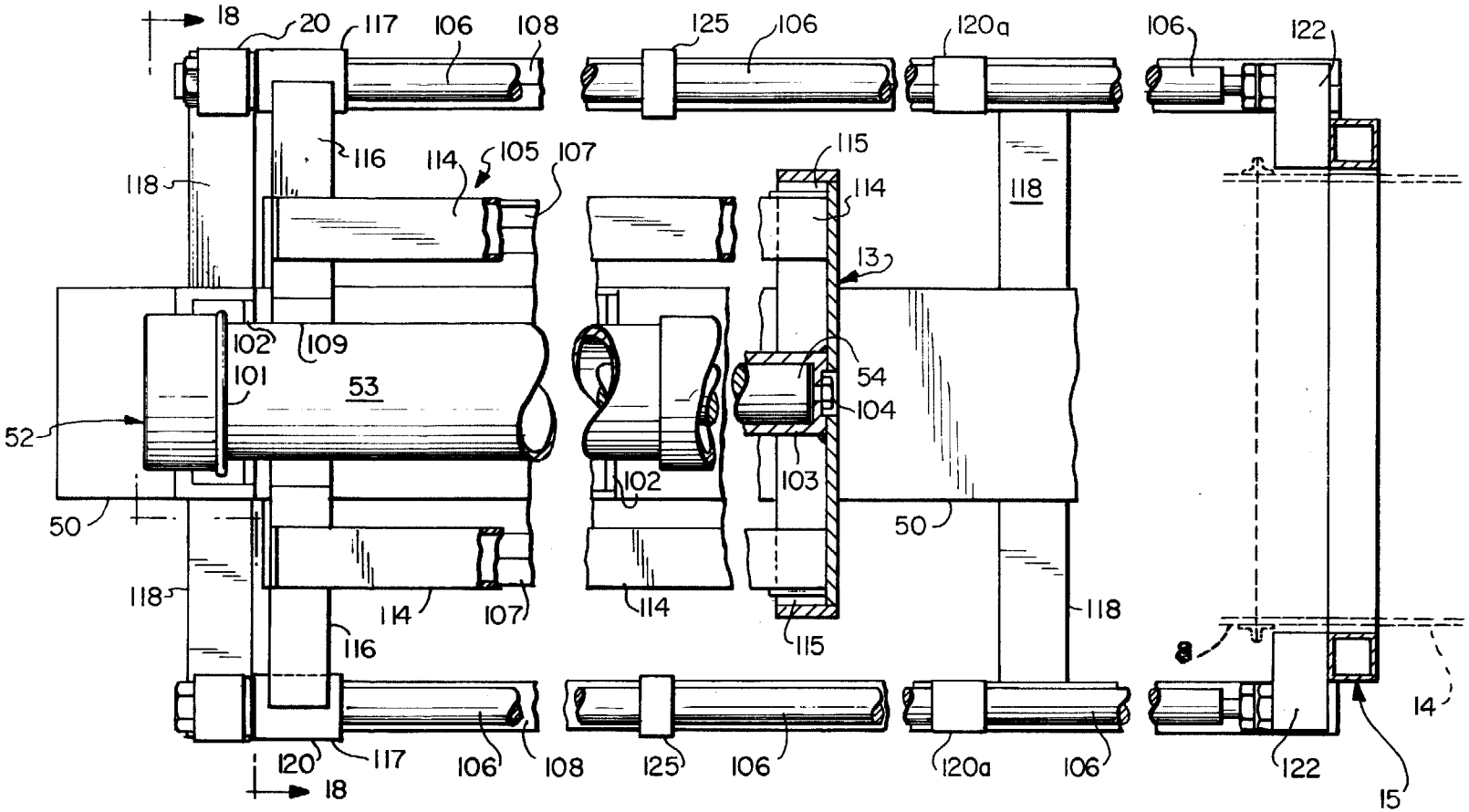
FIG. 17 is a top plan view of a portion of the apparatus of FIG. 11.
Figure 18:
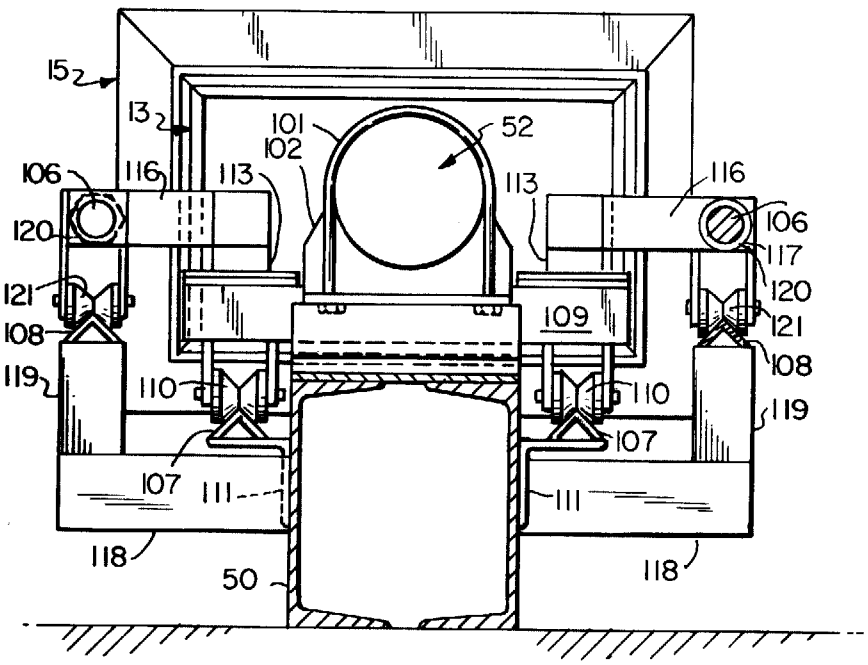
FIG. 18 is a vertical sectional view taken generally on line 18—18, FIG. 17.

Operation of pusher frame 15 is accomplished by motor 52, operating through the pusher assembly indicated generally at 105, FIGS. 17 and 18, and push rods 106, pusher assembly 105 being supported by rails 107 and rods 106 being supported by rails 108. Assembly 105 comprises a transverse beam 109 equipped with grooved rollers 110 which each roll on a different one of the two rails 107. Rails 107 are in the form of angle members welded respectively to the horizontal flanges of two angle members 111 each secured to a different side of frame 50, as shown. Rollers 110 are carried by mounting ears 112 which depend from beam 109, the arrangement being such that beam 109 is supported slightly above the flat upper face of base 50. Two uprights 113 are secured each to a different end of beam 109. Two longitudinal beams 114 are provided, each having one end secured to the respective side flange 115 of ejector ram 13, as seen in FIG. 17. Also secured respectively to uprights 113 are two laterally projecting arms 116. At its outer end, each arm 116 carries a sleeve 117. Each sleeve 117 slidably embraces a different one of push rods 106. The combination of piston rod 54, ejector ram 13, beams 114, beam 109, uprights 113, arms 116 and sleeves 117 constitutes a rigid assembly which moves as a unit during operation of motor 52.

Rails 108 are supported, each in a location below and parallel to a different one of push rods 106, by arms 118 which are welded to and extend laterally from frame 50, and uprights 119 each welded to the outer end of a different one of arms 118. At its end which is more distant from the compression chamber, each rod 106 has secured thereto a carriage 120 equipped with a wheel 121 engaged with the corresponding rail 108. An additional carriage 120*a* is secured to each rod 106 near the opposite end. That end of each rod is rigidly secured to an arm 122, each arm 122 being rigidly secured to a different vertical side of pusher frame 15, as seen in FIG. 17. The combination of rods 106 and pusher frame 15 thus constitutes a rigid assembly capable of moving as a unit.

On each push rod 1–6, in a location between carriages 120 and 120*a*, there is secured to the push rod a collar 125. Since sleeves 117 are slidable on push rods 106, initial operation of motor 52 to drive ejector head 13 through compression chamber 8 does not move push rods 106 and pusher frame 15. Collars 125 are so located that sleeves 117 come into engagement with the respective collars 125 when ejector head 13, and therefore the trailing end of the compressed cake of tobacco or the like, have reached the mouth of sleeve 14. With each sleeve 117 engaging one of the collars 125, further movement of piston rod 54 advances not only the ejector head 13 but also the pusher frame 15. Accordingly, with the pusher frame 15 now advancing along sleeve 14 at the same rate as the compressed cake of material is moved through sleeve 14, ejection of the compressed cake is accomplished without bulg ing of the leading end of the compressed cake and the end wall of the container engaged thereby.

After ejector head 13 has completed its full stroke and the compressed cake has been fully ejected from sleeve 14, motor 52 is reversed to return head 13 to its initial position, in which it again constitutes an end wall of compression chamber 8. Initially during such return of the ejector head, sleeves 117 simply slide on push rods 106. As head 13 returns to the mouth of sleeve 14, however, sleeves 117 come into engagement with the carriages 120 and completion of the return stroke of motor 52 therefore acts to return pusher frame 15 to its initial position. Gate 12 can then be lowered and press ram 7 then returned to its raised position preparatory to the next cycle of operation.

Since gate 12 is of heavy metal plate and is engaged between opposed sets of rollers, i.e., between rollers 80 and 82 and between rollers 81 and 83, the gate is adequately supported to withstand the large forces occurring during operation of the press and is constrained in precise alignment with the opening between the top wall of sleeve 14 and press ram 7, yet is free to move vertically in response to operation of motor 85.

Compression chamber 8 is rigidly secured to base frame 50. Frame 50 terminates adjacent the end of the compression chamber on which sleeve 14 is mounted, and sleeve 14 projects horizontally from the compression chamber in cantilevered fashion, so that the lower member of pusher frame 15 is free to traverse the bottom wall of sleeve 14.

In a typical configuration of the apparatus of FIGS. 11–18, the effective length of sleeve 14 is approximately equal to the internal length of compression chamber 8, and the effective spacing between sleeves 117 and collars or abutment members 125, when the piston rod of motor 50 is fully retracted so that pusher head 13 is in its end-wall-forming position, is equal to the internal length of the compression chamber plus the thickness of gate 12.

What is claimed is:

1. In the production of enclosed bales of compressible material such as tobacco, the method comprising confining a predetermined quantity of the compressible material within an upright zone which terminates at the bottom in a compression zone in the form of a hexahedron which is similar to but slightly smaller than the bale to be formed and which can be placed in communication with a laterally extending sleeve having a transverse cross-sectional shape corresponding to that of the compression zone;

compressing the predetermined quantity of compressible material into the compression zone by forcing a press ram having a flat lower face downwardly through said upright zone until the flat face of the ram forms the top wall of the compression zone;

disposing about the laterally extending sleeve a container having an open end adjacent the compression zone and a closed end extending across the end of the laterally extending sleeve which is more distant from the compression zone;

placing the compression zone in communication with the laterally extending sleeve;

forcing the compressed cake of material from the compression chamber into and through the laterally extending sleeve;

maintaining the container on the sleeve until the compressed cake of material has reached the discharge end of the sleeve;

then positively moving the container over and away from the sleeve in the same direction and at essentially the same speed as the compressed cake is moved by said forcing step;

said steps of forcing the compressed cake and positively moving the container being continued until the cake has passed completely through the sleeve and the container has been removed from the sleeve; and closing the open end of the container;

the compressed cake reexpanding, in the direction in which it was compressed, after the cake has emerged from the sleeve, such reexpansion causing the cake to place the container in tension.

2. The method according to claim 1, wherein the container comprises two boards one disposed over the outer surface of the top wall of the sleeve, the other disposed over the outer surface of the bottom wall of the sleeve; and said step of positively moving the container is carried out by applying force to at least one of said boards.

3. The method according to claim 2, wherein said step of disposing the container about the sleeve comprises telescoping the combination of a bag and said boards over the sleeve with said bag embracing the boards and the sleeve.

4. The method according to claim 2, wherein said step of disposing the container about the sleeve comprises loosely applying at least two transversely extending tie bands about the container; and reexpansion of the compressed cake, after the cake emerges from the sleeve, forces said boards outwardly to tension said tie bands.

5. The method according to claim 4, wherein said tie bands are metal strapping.

6. The method according to claim 4, wherein said step of disposing the container about the sleeve comprises telescoping the combination of a bag and said boards over the sleeve with said bag embracing the boards and the sleeve and with said tie bands external to the bag.

7. The method according to claim 4, wherein said step of disposing the container about the sleeve comprises telescoping a bag over the sleeve and disposing the boards outside the bag, said tie bands extending about said boards.

8. The method according to claim 4, wherein said step of disposing the container about the sleeve comprises disposing a length of flexible material on the sleeve in such fashion that the flexible material extends along one vertical side of the sleeve, folding respective edge portions of the flexible material over the top and bottom of the sleeve, and disposing the boards one over the top and the other over the bottom of the sleeve, the tie bands being outside of the boards.

9. The method according to claim 1, wherein said step of disposing the container about the sleeve includes loosely applying at least one tie member about the container while the container is on the sleeve;

reexpansion of the compressed cake after the cake emerges from the sleeve forcing the container outwardly and placing the tie member in tension.

10. The method according to claim 1, wherein said step of disposing the container about the sleeve includes telescoping the open end of a rectangular carton over the sleeve;

the other end of the carton being closed and extending across the open end of the sleeve.

11. The method according to claim 1, wherein the container is of such material that air trapped therein can not escape freely through the walls of the container;

the method including the additional step of preventing relative movement between the container and the sleeve, in a direction parallel to the movement of the compressed cake through the sleeve, prior to arrival of the leading end of the compressed cake of material at the discharge end of the sleeve.

12. The method according to claim 11, wherein the container is a carton having a liner which resists passage of air;

said step of positively moving the container is accomplished by moving pusher means against the open end of the carton; and said step of preventing relative movement between the carton and the sleeve is accomplished by releasably securing the open end of the carton to the pusher means.

13. In apparatus for producing enclosed bales of compressible material such as tobacco, the combination of upright charger means;

vertical press means comprising a press ram having a flat lower face, and power means for moving said press ram downwardly from an initial position above said charger means to a fully lowered position and then upwardly to said initial position;

feed means for supplying loose compressible material into the charger means;

rectangular compression chamber means located at the bottom of said charger means and comprising two upright opposed side walls, a horizontal bottom wall extending betwen said side walls, and a gate forming one end wall of the compression chamber ane means mounting said gate for movement between an open position and a closed position;

a sleeve having a transverse cross-section of essentially the same rectangular shape and size as the transverse cross-section of the compression chamber defined by the combination of said compression chamber means and the vertical press ram when the vertical press ram is in said fully lowered position;

means mounting said sleeve in horizontal position as an extension of the compression chamber with one end of the sleeve being located at the position occupied by the gate and the other end of the sleeve spaced from the gate by a substantial distance;

the internal and external surfaces of the sleeve being smooth and the thickness of the walls of the sleeve being small in relation to the total transverse cross-section of the sleeve, whereby a container having an open end and transverse dimensions only slightly larger than the transverse dimensions of the interior of the sleeve can be telescoped over said other end of the sleeve.

first pusher means comprising a pusher head, power means for moving said pusher head horizontally between a retracted position, in which the pusher head forms the end wall of the compression chamber opposite the gate, and a fully advanced position at said other end of said sleeve;

downward movement of said press ram through said charger means when the charger means contains a predetermined amount of loose compressible material, when the gate is in its closed position and the pusher head is in its retracted position serving to compress the material into a rectangular cake having the size and dimensions of the compression chamber, movement of the pusher head to its fully advanced position after the gate has been moved to its open position serving to push said cake through the sleeve with the sleeve acting to constrain the cake essentially to the rectangular size and shape of the compression chamber; and container pusher means comprising a push member disposed outside of the sleeve adjacent at least one wall of the sleeve, and means for moving the push member from an initial position, adjacent said one end of the sleeve, and a second position, adjacent the other end of the sleeve, at substantially the same rate of travel as and simultaneously with the first pusher means, such movement of the push member of the container pusher means being effective to push the container off the sleeve concurrently with emergence of the compressed cake from the sleeve.

14. The combination defined in claim 13, wherein said push member of said container pusher means is a rectangular frame embracing said sleeve.

15. The combination defined in claim 13, wherein said means for moving the push member of said pusher means comprises at least one push rod secured to said push member, and means for connecting the power means of said first pusher means to move said push rod to advance said push member along said sleeve only after said pusher head has advanced to said one end of said sleeve.

16. The combination defined in claim 15, wherein the power means of said first pusher means is a fluid pressure operated rectilinear motor generally aligned with the combination of said compression chamber and said sleeve;

the means for moving the push member of said pusher means comprises two push rods each parallel to the longitudinal axis of said sleeve and away from said compression chamber, and lost motion means connecting said elongated members each to a different one of said push rods to move the combination of said push rods and said push member only when said pusher head has advanced said compressed cake to a predetermined position in said sleeve.

17. The combination defined in claim 16, wherein said lost motion means comprises, for each of said push rods, an abutment member secured to the push rod, a force-transmitting member slidable on the push rod, and means connecting said force transmitting member to the corresponding one of said elongated members for movement therewith, operation of the power means of said first pusher member causing the combination of said pusher head, said elongated members, and said force-transmitting members to move as a unit, such movement causing said force-transmitting members to move into engagement with said abutment members, and further operation of said power means then causing said push rods to move and advance said push member along said sleeve.

18. The combination defined in claim 17, wherein said push member of said container pusher means is a rectangular frame embracing said sleeve; and each of said push rods extends on a different side of the compression chamber and is connected to a different side of said frame.

19. The combination defined in claim 13, and further comprising a base frame, said compression chamber being mounted on said base frame, said means mounting said sleeve comprising means securing said one end of said sleeve to the adjacent end of said compression chamber, said base frame terminating adjacent said one end of said compression chamber, said sleeve projecting in cantilevered fashion from said compression chamber;

said push member of said container pusher means including a member extending transversely across the bottom of said sleeve.

20. The combination defined in claim 19, wherein said push member is a rectangular frame embracing said sleeve, and said member extending transversely across the bottom of said sleeve is the lower side member of said rectangular frame.

21. The combination defined in claim 13, wherein said means mounting said gate is mounted on said upright charger means.

22. The combination defined in claim 13, wherein said means mounting said gate comprises a plurality of rollers so arranged that the gate is engaged between opposing sets of said rollers.

* * * * *